United States Patent [19]

Knapp

[11] Patent Number: 4,603,449

[45] Date of Patent: Aug. 5, 1986

[54] UNITIZED PIG BODY FOR PARAFIN REMOVAL

[76] Inventor: Kenneth M. Knapp, 1209 Hardy St., Houston, Tex. 77020

[21] Appl. No.: 730,271

[22] Filed: May 3, 1985

[51] Int. Cl.[4] ..... B08B 9/04

[52] U.S. Cl. ..... 15/104.06 R

[58] Field of Search ..... 15/104.06 R, 104.06 A, 15/3.5, 3.51; 166/191, 153–156; 137/268

[56] References Cited

U.S. PATENT DOCUMENTS

| | | | |
|---|---|---|---|
| 3,685,083 | 8/1972 | Jones | 15/104.06 R |
| 3,857,132 | 12/1974 | Knapp et al. | 15/104.06 R |
| 3,939,519 | 2/1976 | Muirhead | 15/104.06 R |

*Primary Examiner*—Edward L. Roberts

*Attorney, Agent, or Firm*—Gunn, Lee & Jackson

[57] ABSTRACT

Parafin scrapping, disc equipped, unitized pigs are disclosed. The leading disc is undergage by 0.01 to 0.05" and has a durometer of 85 to 95. N scrapper discs are included and have hardness between 65 and 75, and are overgage by a specific size. The pig is equipped with a rear disc similar to the leading disc.

11 Claims, 2 Drawing Figures

UNITIZED PIG BODY FOR PARAFIN REMOVAL

BACKGROUND OF THE DISCLOSURE

In pipelines delivering produced crude oil, parafin coating of the pipeline is a potential problem. Parafin, wax or asphaltene may coat the interior of the pipeline, thereby placing a narrow constriction in the pipeline and reducing its flow capacity. The coating material will be described as a parafin coating but the term will be understood to include other constituents of the produced oil which coat the pipe to form a constriction in the pipeline.

Perhaps an example will describe the situation readily. Assume that several deep wells produce oil from significant depth at an elevated temperature. Assume that the wells are below an offshore platform which is connected with a storage facility that is located many miles away. An underwater pipeline extends from the producing wells to the storage facility. Assume further that the water temperature is substantially cooler than the produced oil. As a matter of fact, the water can be quite cold as would occur with offshore wells located in the North Sea, near Alaska, or in other northern latitudes. In that instance, a very substantial temperature drop is experienced by the oil and this causes the heavier molecules to thicken and form a parafin coating in the pipeline.

Molecules of many different weights may deposit into the coating material. Those which are extremely heavy molecules more readily stick while the lighter molecules may dissolve from the coating. There is a tendency for lighter molecules to dissolve into the liquid leaving only heavier molecules, and over a period of time, the coating can become hard. Typically, this occurs with the greatest hardness adjacent to the pipe, and the newer strata of the coating are usually much lighter and also softer. In other words, the coating will vary in hardness.

Pigs have been used to remove parafin. There are several problems that relate to parafin scraping from a pipeline. First of all, pigs fabricated with metal bodies or with steel mandrels supporting rubber scrappers run the risk of breaking up in the pipeline. While it may be rare, nevertheless, it does occur and in that instance, the broken pieces of the steel member are carried along the pipeline and often destroy downstream equipment including pumps. This creates severe damage and requires expensive repairs.

There is another limitation to parafin scraping of the coated material in a pipeline. The coating is made of molecules of different weights and therefore has variations of hardness. If the coating is unsuccessfully scrapped, it tends to pack the parafin and form a harder coating, typically by squeezing only the lighter portions. As an example, it may remove most of the lighter portions but it may leave a much harder film coating in the pipe. At that juncture, the coating hardness approaches that of candle wax and is extremely difficult to remove.

Removal at this stage is not readily accomplished. Solvents which successfully remove parafin cannot be easily used in pipelines which are extremely long because of unreasonable cost. Thus, the accumulation of parafin as hard a candle wax is highly undesirable. This hard coating can regretably be left in a pipeline by scrapping improperly without dislodging a significant portion of material in the pipeline. The present apparatus sets forth a scrapping pig for a pipe suspected of having parafin coating in the pipe. It has the advantage of providing a unitized pig body formed of elastomeric materials. The materials are formed into a central column having a number of discs thereabout. The front or leading disc is made stronger, harder and stiffer than the remaining discs. The front disc is undergage while the softer discs are overgage. The softer discs accomplish sealing and scraping and yet they are soft thereby flexing to assure that dislodged particles of wax can then float down the pipeline. The softer (sealing) discs are more easily deflected as will be described thereby enabling more certain contact with the pipeline for cleaning parafin. Thus, the unitized pig of the present disclosure accomplishes paraffin removal.

While the foregoing speaks generally of problems encountered in pipeline paraffin removal, the preferred embodiment sets forth a more specific disclosure of a unitized pig for accomplishing paraffin removal, and other objects and advantages will become more readily apparent on consideration of the below written specification accompanied with the drawings attached hereto.

BRIEF DESCRIPTION OF THE DRAWINGS

So that the manner in which the above-recited features, advantages and objects of the present invention, as well as others which will become apparent, are attained and can be understood in detail, a more particular description of the invention, briefly summarized above, may be had by reference to the embodiments thereof illustrated in the appended drawings, which drawings form a part of this specification.

It is to be noted, however, that the appended drawings illustrate only typical embodiments of this invention and are not to be considered limiting of its scope, for the invention may admit to other equally effective embodiments.

DETAILED DESCRIPTION OF THE PREFERRED EMBODIMENTS

Figure 1:
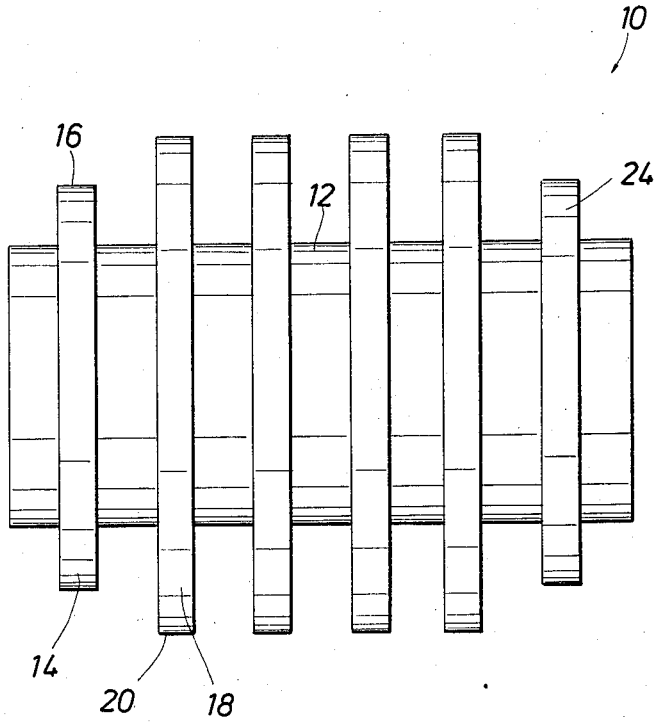
FIG. 1 shows a unitized scrapper pig for paraffin removal from a pipeline constructed in accordance with the teaching of the present disclosure.

Attention is first directed to FIG. 1 of the drawings where the numeral 10 identifies a unitized pig constructed in accordance with the teachings of the present disclosure. The pig has an elongate central column 12 which is substantially smaller in diameter than the pipeline. It supports a number of discs or cups as will be described. The embodiment 10 utilizes several discs. The pipeline pig 10 is typically constructed of polyurethane as the preferred material. Other elastromers may be used also. It is formed by continuous pouring so as to comprise a cast body without joint seam or weld. It is formed with a leading edge disc 14. The disc 14 has an outer face 16. Preferably, the disc is formed of a relatively hard material, the preferred material being polyurethane having a hardness of about 85 to about 95 durometer. This hardness enables the completed disc to be machined. Thus, the disc 14 is cast to a larger diameter. After casting, it is preferably machined to a smaller size by machining away a portion of the material at the outer face 16. It is machined to a size which is approximately 0.01" to about 0.05" less then the gage of the pipeline. The term "gage" refers to the nominal i.d. of the pipeline. Here, it is assumed that all the joints that make up the pipeline have a common i.d. and are also truly ground. Understandably, they are not equal in diameter and they are not always perfectly round. However, to the measure that variations occur, the pig of the present disclosure is resilient and can flex and bend to accomodate undersized or non-round pipe during travel.

The disc 14 is thus machined to be slightly smaller or undergage for the pipe i.d. By constrast, a sealing scrapper disc 18 is formed with an outer face 20 which is larger in diameter then the adjacent disc. This disc is formed of polyurethane which is controllably made to have reduced hardness. It has a hardness in the range of about 65 to about 75 durometer. The durometer difference is preferably 20 or more units. In typical circumstances, it is formed to the same original diameter of the discs 14 which is later machined to a smaller size. The disc 18 is overgage or larger then the nominal i.d. of the pipe. In smaller sizes, i is overgage by a minimum of approximately 0.02" to about 0.05". That is, it is oversized by this minimum measure. In light of the fact that the pig can be made for different diameter pipes, it is better that the pig be oversized by a measure related to nominal pig i.d. A convenient minimum relationship is to make the pig disc 18 oversized by an amount of approximately 0.02" plug 0.01 times pipe diameter in inches. For a 24 inch pipeline, an oversized disc has a minimum of 0.26" to enable sealing scrapping. As a practical matter, for pipe above about 4 inches i.d., the overgage is up to about 0.02 plus 0.02 times nominal pipe i.d. Thus, the range of overgage can be defined as 0.02 plus pipe i.d. times 0.01 to about 0.02. On a large pig (say 24 inches), the diameter can be up to about 0.02" plus about 0.98" oversize; about 1.00" is the reasonable maximum.

Preferably, the first and second disc differ by at least about 20 units in durometer hardness. It is desirable to manufacture the pig with discs of relatively uniform thickness. However, the deflectability of the scrapper disc 18 can be changed by modification of its thickness. Considering variations in durometer and thickness, it is preferable to construct the disc 18 so that it deflects between 3 and 7 times further on equal loading. That is, when a force is applied at the edge of the respective discs on the pig 10, deflection is larger by this amount. It is preferable to construct the disc 18 with approximately the same thickness as the disc 14, or perhaps even thicker because the wear occurs on the outer edges of the scrapper disc 18.

The pig body supports several identical scrapper discs. While 4 are shown in the embodiment 10, the number N (an integer) is typically between about 2 and 8. There is a point of diminishing returns on increasing above this number of scrapper disc.

The pig is preferably made bidirectional by constructing another hard disc 24 at the opposite end of the pig. Thus, the discs 14 and 24 are identical in construction, hardness, and diameter. They are made undergage by the same measure as previously mentioned. This enables the pig to be inserted into the pipeline without regard to direction. Moreover, it enables the pig to last longer in use. When the pig is inserted into the pipeline where the disc 14 is the leading dic, wear accumulates on the forward discs of the pig body and the back discs are less worn. After use, the pig can then be reversed and inserted into the pipeline wherein the disc 24 is the leading disc. This will more evenly distribute wear along the pig body and thereby extend the life of the pig body.

Figure 2:
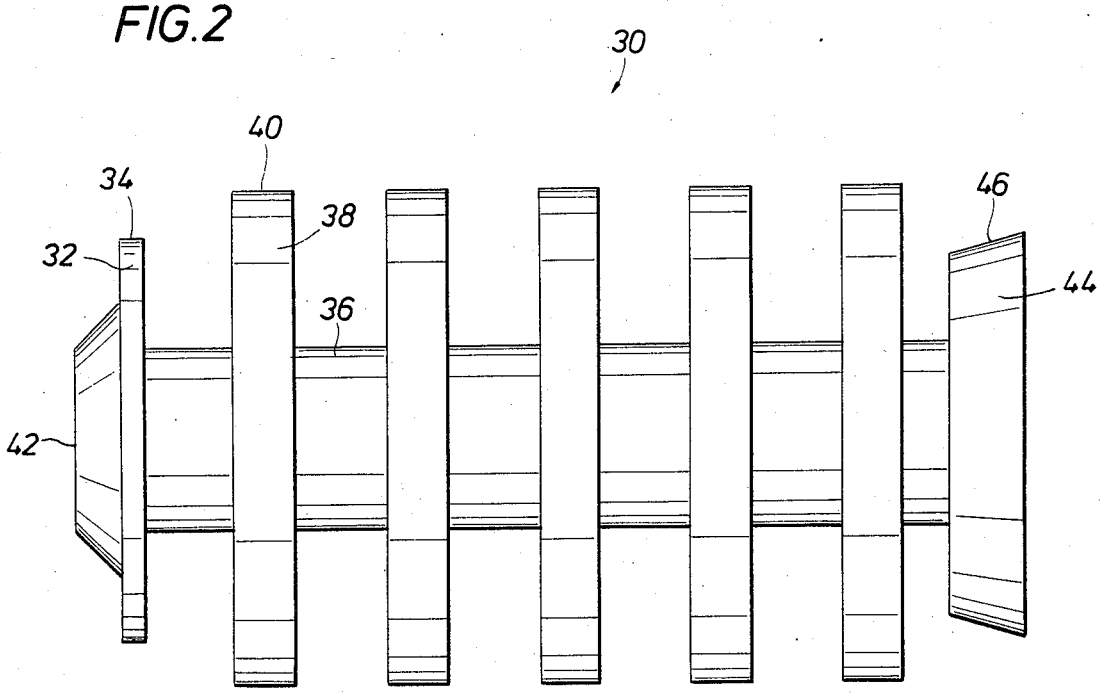
FIG. 2 shows an alternate embodiment of a unitized scrapper pig of the present disclosure.

Attention is now directed to the embodiment 30 shown in FIG. 2. Again, there is a leading disc 32 having a machined face 34. The disc 32 is supported on the mandrel or column 36. Scrapper discs are also included at 38. The scrapper disc has an outer face 40 adapted to be overgaged in the same fashion as was the embodiment 10. The pig 30 is thus a unitized construction pig having harder material, approximately the same durometer as described before. The back or trailing disc is more in the form of a cup 44 having a tapered outer face 46. It preferably has the same diameter as the machined diameter 34 on the front disc. The intermediate discs are all formed of the softer material and hence, the difference in hardness between the two types of material forming the unitized body is again approximately the same difference as that for the embodiment 10.

While the foregoing is directed to the preferred embodiments, the scope of the present disclosure is determined by the claims which follow.

What is claimed is:

1. A unitized paraffin scrapping pig comprising an elongate body having a leading end disc which is undergaged, at least two intermediate discs on said body which are overgaged, and wherein said leading disc is at least about 90 durometer and said leading disc is at least about 20 durometer harder then said intermediate discs.

2. The apparatus of claim 1 wherein said leading disc is undergaged in the range of about 0.01" to about 0.05".

3. The apparatus of claim 1 wherein said intermediate discs are (overgaged) by at least 0.02".

4. The apparatus of claim 1 wherein there are N intermediate discs and N is an integer between 2 and 8.

5. The apparatus of claim 1 wherein said intermediate discs deflect between 3 and 7 times greater than said leading disc in response to equal loading thereon.

6. The apparatus of claim 1 wherein said intermediate discs are overgage by 0.01" plus 0.01" times pig diameter and are less than 1.00" overgage.

7. The apparatus of claim 6, including a symmetrically shaped rear disc.

8. The apparatus of claim 6 including N spaced discs between said leading and rear discs where N is an integer between 2 and 8.

9. The apparatus of claim 1 wherein said leading disc is between 85 and 95 durometer hardness.

10. The apparatus of claim 9 wherein said leading disc has a machined perpendicular outer face.

11. The apparatus of claim 9 including a rear disc of similar hardness and size to said leading disc.

* * * * *